United States Patent [19]

Watanabe et al.

[11] Patent Number: 4,740,354

[45] Date of Patent: Apr. 26, 1988

[54] NICKEL-BASE ALLOYS FOR HIGH-TEMPERATURE FORGING DIES USABLE IN ATMOSPHERE

[75] Inventors: Rikizo Watanabe; Takehiro Ohno; Toshiaki Nonomura, all of Shimane, Japan

[73] Assignee: Hitachi, Metals Ltd., Tokyo, Japan

[21] Appl. No.: 909,226

[22] Filed: Sep. 19, 1986

Related U.S. Application Data

[63] Continuation of Ser. No. 424,201, Apr. 17, 1985, abandoned.

[51] Int. Cl.[4] ..... C22C 19/03

[52] U.S. Cl. ..... 420/455; 420/460

[58] Field of Search ..... 420/455, 460; 148/429

[56] References Cited

U.S. PATENT DOCUMENTS 2,542,962 2/1951 Kinsey ..... 420/460

*Primary Examiner*—R. Dean

*Attorney, Agent, or Firm*—Antonelli, Terry & Wands

[57] ABSTRACT

A nickel-base cast alloy for use in high-temperature forging dies operable in the atmosphere, consisting essentially of 4–10 weight % of Al, 13–23 weight % of Mo and the balance of Ni and impurities. The nickel-base cast alloy may further contain up to 0.1 weight % of at least one of rare earth metals and Y. It may also contain up to 15 weight % of W and/or Ta substituting for a part of Mo. Ni may be replaced by up to 20 weight % of Co. The cast alloy of the present invention has high resistance to compression deformation and oxidation.

6 Claims, No Drawings

NICKEL-BASE ALLOYS FOR HIGH-TEMPERATURE FORGING DIES USABLE IN ATMOSPHERE

This is a continuation of application Ser. No. 724,201, filed Apr. 17, 1985, abandoned.

BACKGROUND OF THE INVENTION

1. Field of the Invention

The present invention relates to nickel-base alloys for isothermal forging dies operable at high temperatures in the atmosphere. More particularly, it relates to nickel-base superalloys for use in dies for isothermal forging at high temperatures of 1000°–1150° C. in the atmosphere.

2. Description of the Prior Art

Conventional dies for isothermal forging at temperatures of 1000° C. or higher are made of molybdenum-base alloys such as TZM (0.5% Ti, 0.08% Zr and Bal. Mo). These alloys, however, have poor oxidation resistance, so forging operations must be conducted in vacuum or in an inert atmosphere. This makes isothermal forging facilities rather complicated and costly, leaving the forging operations inefficient and costly.

Nickel-base superalloys such as MAR-M200 (60% Ni, 9.0% Cr, 10.0% Co, 12.0% W, 5.0% Al, 2.0% Ti, 1.0% Cb, 0.15% C, 0.015% B and 0.05% Zr by weight) are widely used for jet engine turbines. See "High Temperature, High strength Nickel Base Alloys," July 1977. However, these alloys do not have sufficiently high temperature compression strength at temperatures of 1000° C. or higher, despite the fact that they may be used in the atmosphere because of their high resistance to oxidation. Therefore, they cannot be used for isothermal forging dies which may be subjected to such high temperatures as 1000° C. or more.

Nickel-molybdenum-aluminum alloys have also been proposed for use in gas turbine engines. Nickel-aluminum-molybdenum alloys produced by rapid solidification rate process (RSR) were disclosed by A. R. Cox, "Potential Uses of Rapidly Solidified Alloys in Gas Turbine Engines," Metals Technology, June 1980, pp. 238–243, and by R. J. Patterson II, "Rapid Solidification Rate Processing and Application to Turbine Engine Materials," Journal of Metals, September 1980, pp. 34–39. Also, a single crystal Ni-Mo-Al-Ta superalloy called MMT 143 was disclosed by D. D. Pearson et al., "Stress Coarsening of $\gamma'$ and Its Influence on Creep Properties of a Single Crystal Superalloy," Superalloys, 1980, pp. 513–520. All of these alloys were intended to be used for gas turbine engines.

It has never been intended to use nickel-aluminum-molybdenum alloys for isothermal forging dies which are to be operated repeatedly at temperatures of 1000° C. or higher for a long period of time. Alloys for such isothermal forging dies must meet the requirements of high resistance to compression deformation and oxidation under severe forging conditions.

OBJECT AND SUMMARY OF THE INVENTION

An object of the present invention, therefore, is to provide a nickel-base cast alloy suitable for isothermal forging dies operable in the atmosphere.

A nickel-base cast alloy for high-temperature forging dies operable in the atmosphere according to the present invention consists essentially of 4–10 weight % of Al, 13–23 weight % of Mo and the balance of Ni and impurities.

The nickel-base cast alloy of the present invention may further contain up to 0.1 weight % of at least one of rare earth elements and yttrium.

DETAILED DESCRIPTION OF THE INVENTION

Al is an essential element not only for creating gamma-prime ($\gamma'$) precipitate phases which serve to increase the high-temperature compression strength of the alloy, but also for forming an oxide (alumina) film on the alloy surface which serves to make the alloy have high resistance to oxidation. In order to impart sufficient high-temperature compression strength and oxidation resistance to the alloy, Al should be at least 4 weight %. However, when it exceeds 10 weight %, eutectic gamma-prime phases are excessively formed, rather lowering the high-temperature compression strength of the alloy. Accordingly, Al should be 4–10 weight %. The preferred amount of Al is 5–8 weight %.

Mo is an indispensable element which is solved in both $\gamma$ and $\gamma'$ phases to strengthen them, thereby enhancing the high-temperature compression strength of the alloy according to the present invention. To achieve sufficient strengthening effects, Mo should be at least 13 weight %. However, when it exceeds 23 weight %, too much $\alpha$-Mo phase is formed, making the alloy brittle and lowering the oxidation resistance of the alloy. Accordingly, Mo should be 13–23 weight %. The preferred amount of Mo is 15–20 weight %.

Since W and Ta provide essentially the same effects, as Mo, of increasing high-temperature compression strength, they may be used alone or in combination in place of part of Mo. Both W and Ta are almost double as large as Mo in terms of atomic weight, so almost double amounts by weight of W and Ta should be added in order to make up for the same atomic percentage of Mo removed. However, since W and Ta are actually more effective than Mo, they need not be double the amount of Mo replaced. In effect, W and Ta are equivalent to 1.5 times Mo as far as the capability of increasing high-temperature compression strength is concerned. Accordingly, the following formula should be satisfied:

$$13 \leqq Mo + \tfrac{2}{3}(W+Ta) \leqq 23$$

It should be noted that in the above formula, (W+Ta) means W or Ta when only either one of W and Ta is added. Typically, a part of Mo may be replaced by 1.5 times as much as W and/or Ta to retain the same effects.

Specifically speaking, W functions to increase high-temperature strength of the alloy but decreases oxidation resistance thereof. On the other hand, Ta enhances oxidation resistance of the alloy while it somewhat lowers high-temperature strength thereof. These tendencies become remarkable particularly when W or Ta exceeds 15 weight %. In any case, when the sum of W and Ta exceeds 15 weight %, the alloy has an excessively high specific gravity and becomes too expensive. In view of the above, W and/or Ta in sum should be at most 15 weight %, which corresponds to 10 weight of Mo in terms of the capability of increasing high-temperature compression strength. The preferred range of W and/or Ta is 5–15 weight %. When W and/or Ta exists, Mo is preferably 8–15 weight %.

The nickel-base alloy of the present invention may contain at least one of rare earth elements and yttrium. The rare earth elements mentioned herein comprise La, Ce, Pr, Nd, Pm, Sm, Eu, Gd, Tb, Dy, Ho, Er, Tu, Yb and Lu. The rare earth elements and yttrium serve to enhance the oxidation resistance of the alloy at the initial stage of heating. However, excess amounts of rare earth elements and yttrium lower the melting point of the alloy, thereby deteriorating its high-temperature compression strength. Accordingly, the upper limit of these elements which may be added is 0.1 weight %, preferably 0.05 weight %. The lower limit of these elements, on the other hand, may be 0.0005 weight % to provide sufficient effects of preventing oxidation. In the case of the alloy according to the present invention, yttrium is particularly desirable because it less tends to lower the melting point of the alloy than the rare earth elements.

Nickel is a base element for forming not only gamma ($\gamma$) phase but also gamma-prime ($\gamma'$) phase in the alloy of the present invention. It constitutes the balance of the alloy except for impurities. Up to 20 weight % of Ni may be replaced by Co with slight increase in high-temperature compression strength and slight decrease in oxidation resistance. When Co exceeds 20 weight %, harmful intermetallic compounds such as mu ($\mu$) phases are formed in place of the $\alpha$-Mo phase, making the alloy brittle. Thus, the amount of Co substituted for Ni should be up to 20 weight %.

It should be noted that the important feature of the present invention is that the alloy of the present invention contains substantially no chromium unlike conventional nickel-base superalloys. Further, the alloy of the present invention does not substantially contain carbon, titanium, boron and zirconium.

The following elements which may be regarded as impurities should be limited as follows:

Mn≦1.0 wt. %
Hf≦1.0 wt. %
Cu≦0.5 wt. %
V≦1.0 wt. %
Nb≦2 0 wt. %
Mg≦0.1 wt. %
Ca≦0.1 wt. %
Si≦0.5 wt. %
P≦0.03 wt. %
S≦0 03 wt. %

Some of these elements such as Hf, V and Nb may not be regarded as impurities, because they do not substantially affect the properties of the alloy as long as their amounts are within the above limits, so that they may be added intentionally within the limits. For the sake of simplicity, however, all of the above elements are called impurities herein.

The alloy of the present invention may be directly cast into dies of the desired designs, or may be cast into blocks and then machined to form the desired dies. After or before precision machining, the dies may be subjected to a heat treatment which comprises a solution treatment at 1100° C.–1300° C. and aging at 600° C.–1100° C.

The present invention will be described in further detail by mean of the following Examples.

EXAMPLE 1

The alloys of the present invention having the compositions as listed in Table below were prepared by melting alloy materials in an induction furnace in the atmosphere and casting them in the atmosphere. The resulting cast alloys were machined to provide specimens of 10 mm$\phi$×12 mm and 10 mm$\phi$×20 mm. The specimens of 10 mm$\phi$×12 mm were subjected to compression tests under the conditions of 1100° C., $10^{-3}$ $sec^{-1}$ of strain rate and up to 10% of compression, and to creep tests under the conditions of 1100° C. and 10 kgf/mm$^2$ for 20 hours. The specimens of 10$\phi$×20 mm were subjected to oxidation tests which consisted of five cycles of heating at 1100° C. for 16 hours and air cooling. The same tests were carried out on comparative alloys (Nos. 11 and 12) and conventional alloys (Nos. 21 and 31) having the compositions as listed in Table below. The conventional alloys 21 and 31 represent MAR-M200 and TZM, respectively. The results are shown in Table.

TABLE

| | Composition (wt. %) | | | | | | | | Compression Deformation Resistance | Compression Creep | Reduction in Weight by Oxidation |
|---|---|---|---|---|---|---|---|---|---|---|---|
| No. | Ni | Co | Al | Mo | W | Ta | R.E.[1] | Others | (kgf/mm$^2$) | (%) | (mg/cm$^2$) |
| 1 | Bal. | — | 7.4 | 17.7 | — | — | — | | 42 | 1.3 | 2.1 |
| 2 | Bal. | — | 7.1 | 13.9 | 5.9 | — | — | | 44 | 0.4 | 4.2 |
| 3 | Bal. | — | 8.0 | 17.9 | — | — | Y0.01 | | 41 | 1.9 | 0.9 |
| 4 | Bal. | — | 7.0 | 14.1 | 5.9 | — | Y0.01 | | 46 | 0.3 | 0.4 |
| 5 | Bal. | — | 6.2 | 10.1 | 12.0 | — | Y0.01 | | 57 | 0.1 | −1.2 |
| 6 | Bal. | — | 5.0 | 9.9 | 5.8 | 5.8 | Y0.01 | | 45 | 0.3 | −0.3 |
| 7 | Bal. | — | 6.1 | 14.0 | — | 5.8 | Y0.01 | | 37 | 2.1 | 0.4 |
| 8 | Bal. | — | 7.2 | 14.1 | 5.8 | — | La0.02 | | 43 | 1.0 | 0.8 |
| 9 | Bal. | 8.0 | 6.3 | 9.4 | 12.3 | — | Y0.01 | | 59 | 0.1 | 1.3 |
| 11 | Bal. | — | 5.1 | 6.1 | 17.8 | — | Y0.01 | | 49 | 0.2 | 199.6 |
| 12 | Bal. | — | 4.5 | 5.9 | — | 18.4 | Y0.01 | | 23 | >10 | −0.5 |
| 21 | Bal. | 9.8 | 5.1 | — | 11.8 | — | — | Co14 Cr8.6 Ti2.2 Nb1.1 B0.015 Zr0.10 | 25 | >10 | 0.3 |
| 31 | — | — | — | Bal. | — | — | — | Ti0.5 Zr0.08 | 55 | — | — |

Note
[1]R.E. represents rare earth elements and/or Y.

As is apparent from the Table, the alloys of the present invention (Nos. 1–9) have such a high resistance to compression deformation as more than 30 kgf/mm$^2$ and good oxidation resistance of less than 5 mg/cm$^2$ as defined by the reduction in weight by oxidation. The above level is much lower than the permissible upper limit of 20 mg/cm$^2$. Incidentally, in the alloys (Nos. 5 and 6), minus reduction in weight by oxidation means that the weight of a specimen is increased by forming oxides which do not peel off. The minus reduction means good oxidation resistance.

It is observed that the alloys of the present invention have much higher resistance to compression deformation and compression creep at high temperatures than the conventional superalloys, that their compression deformation resistance is almost on the same level as that of the Mo-base alloy (TZM), and that they have oxidation resistance which is substantially on the same level as that of the conventional superalloy (MAR-M200). Thus, it may be considered that the alloys of the present invention are suitable for dies which are used for forging at high temperatures of 1000° C. or more in the atmosphere.

Incidentally, though the data of reduction in weight by oxidation is not shown for alloy No. 31 (TZM), it is obvious that this Mo-base alloy would be too much oxidated under the above-mentioned test conditions. Further, it is apparent that the comparative alloys which fail to meet the composition requirements of the present invention do not have a satisfactory combination of high compression strength and oxidation resistance.

EXAMPLE 2

Alloy No. 1 was cast into upper and lower dieseach 20 mmϕ×35 mm. 1N 100 (60% Ni, 10.0% Cr, 15.0% Co, 3.0% Mo, 5.5% Al, 4.7% Ti, 0.18% C, 0.014% B, 0.06% Zr and 1.0% V by weight) was extruded from powder into a sample of 10 mmϕ×12 mm. The alloy sample was subjected to a 75% upset forging at the initial deformation speed of $10^{-3}$ $sec^{-1}$ while heating both the sample and the dies at 1050° C. After the operation, neither deformation nor surface damages due to oxidation were appreciated on the upper and lower dies. This means that Alloy No. 1 is highly suitable for dies for isothermal forging in the atmosphere.

EXAMPLE 3

Alloy No. 5 in the Table was cast and worked into the upper and lower dies defining a cavity of 16 mmo×3 mm together. Waspaloy (19.5% Cr, 13.5% Co, 4.3% Mo, 1.3% Al, 3.0% Ti, 0.08% C, 0.006% B, 0.06% Zr, Bal. Ni) was formed into ten samples-each 7.5 mmϕ×15.2 mm. Each sample was subjected to isothermal forging at 1050° C. at a constant deformation rate of $10^{-3}$/sec. in the atmosphere using the above dies. As a result, well forged products were obtained without causing any damages to the dies.

As mentioned above, the alloy of the present invention is highly suitable for isothermal forging dies for use at temperatures of 1000° C. or higher, which means that the dies made of the cast alloy of the present invention may be subjected to isothermal forging at high temperatures for a considerably long period of time with substantially no deformatio and oxidation. The cast alloy of the present invention is also advantageous over the conventional Mo-base alloys in that the former is much cheaper than the latter and that the former need not be used in vacuum or inert atmosphere unlike the latter. Thus, inexpensive isothermal forging can be achieved by using the dies made of the cast alloy of the present invention.

What is claimed is:

1. A nickel-base cast alloy for use in high-temperature forging dies operable in the atmosphere, consisting essentially of 5–7.2 weight percentage of Al, 8–15 weight percentage of Mo, 5–15 weight percentage of W and/or Ta and 0.0005–0.05 weight percentage of at least one of rare earth metals and Y, the balance being substantially Ni and impurities.

2. The nickel-base cast alloy according to claim 1, wherein Ni is replaced by up to 20 weight percentage of Co.

3. A nickel-base cast alloy for use in high-temperature forging dies operable in the atmosphere, consisting essentially of 5–7.2 weight percentage of Al, 8–15 weight percentage of Mo, 5–15 weight percentage of W and 0.0005–0.05 weight percentage of at least one rare earth metals and Y, the balance being substantially Ni and impurities.

4. The nickel-base cast alloy according to claim 3, wherein Ni is replaced by up to 20 weight percentage of Co.

5. The nickel-base cast alloy for use in high-temperature forging dies operable in the atmosphere, consisting essentially of 5.5–7 weight percentage of Al, 8.5–11.5 weight percentage of Mo, 11–13 weight percentage of W and 0.0005–0.05 weight percentage of Y, the balance being substantially Ni and impurities.

6. The nickel-base cast alloy for use in high-temperature forging dies operable in the atmosphere, consisting essentially of about 6 weight percentage of Al, about 10 weight percentage of Mo, about 12 weight percentage of W and about 0.01 weight percentage of Y, the balance being substantially Ni and impurities.

* * * * *